US006648053B2

(12) United States Patent
Allor et al.

(10) Patent No.: US 6,648,053 B2
(45) Date of Patent: Nov. 18, 2003

(54) METHOD AND APPARATUS FOR CONTROLLING A SPRAY FORM PROCESS BASED ON SENSED SURFACE TEMPERATURES

(75) Inventors: Richard L. Allor, Livonia, MI (US); John Richard Baer, Carleton, MI (US); Kevin Patrick Regan, Troy, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/683,153

(22) Filed: Nov. 27, 2001

(65) Prior Publication Data

US 2002/0153117 A1 Oct. 24, 2002

Related U.S. Application Data

(60) Provisional application No. 60/284,167, filed on Apr. 17, 2001.

(51) Int. Cl.[7] ..... B22D 23/00; B22D 46/00

(52) U.S. Cl. ..... 164/46; 164/94; 164/4.1; 427/455

(58) Field of Search ..... 164/46, 271, 150.1, 164/151.4, 155.1, 155.4, 155.6, 94, 4.1; 427/455

(56) References Cited

U.S. PATENT DOCUMENTS

| | | | | |
|---|---|---|---|---|
| 4,489,107 A | | 12/1984 | Pech | 427/162 |
| 4,505,945 A | | 3/1985 | Dubust et al. | 427/8 |
| 4,956,538 A | * | 9/1990 | Moslehi | 219/121.6 |
| 5,047,612 A | * | 9/1991 | Savkar et al. | 219/121.47 |
| 5,430,376 A | | 7/1995 | Viertl | 324/227 |
| 5,658,506 A | | 8/1997 | White et al. | 264/28 |
| 5,731,030 A | | 3/1998 | Friese et al. | 427/8 |
| 5,952,056 A | | 9/1999 | Jordan et al. | 427/455 |
| 5,960,853 A | * | 10/1999 | Sterett et al. | 164/271 |

FOREIGN PATENT DOCUMENTS

| | | | |
|---|---|---|---|
| DE | 19545005 A1 | | 6/1997 |
| DE | 19837400 C1 | | 11/1999 |
| DE | 19837400 | * | 11/1999 |
| GB | 1512150 | | 5/1978 |

OTHER PUBLICATIONS

RADIP Tooling—Changing the Face of Manufacturing, Compact Disc Digital Data, dated Oct. 12, 2000, trt: 10:50.

J.E. Craig; R.A. Parker; D.Y. Lee; F.S. Biancaniello; S. Ridder; and S.P. Mates, Particle Temperature Measurements by Spectroscopic and Two–Wavelength Streak Imaging, May 2000, pp. 1–6, TD99–06, Published in the Proceeding of the 1st International Thermal Spray Conference—Montreal.

J.E. Craig; R.A. Parker; D.Y. Lee; F.S. Biancaniello; and S. Ridder, Temperature Imaging Measurements with a Two–Wavelength Imaging Pyrometer, pp. 1–7, PR9082.

Co–pending United States Patent Application No. 09/683,154 entitled "An Automated Inv: ALLOR, Sprayform Cell" and filed Nov. 27, 2001.

(List continued on next page.)

*Primary Examiner*—Tom Dunn
*Assistant Examiner*—I.-H. Lin
(74) *Attorney, Agent, or Firm*—Brooks & Kushman P.C.; Damian Porcari

(57) ABSTRACT

Method and apparatus incorporating an infrared sensor, in the form of a two-wavelength imaging pyrometer into a metallic spray form process for providing real-time measurement of the surface temperature distribution of a steel billet thereby formed. The steel billets may be advantageously used as tools in metal forming processes, injection molding, die casting tooling and other processes that require hard tooling, such as in the automotive industry. The steel billet is formed based on a goal of uniform surface temperature distribution thereby minimizing thermal stresses induced within the steel article thereby produced.

35 Claims, 10 Drawing Sheets

OTHER PUBLICATIONS

K–H Busse; Arc Spraying Of Corded Wires; Thermal Spraying; Jun. 1989; 19–28.

Steeper et al.; A Taguchi Experimental Design Study Of Twin–Wire Electric Arc Sprayed Aluminum Coatings; Proceedings of the International Thermal Spray Conference & Exposition; May 28–Jun. 5, 1992; 427–432; Orlando, FL.

Akira Ohmori; Thermal Spraying Current Status And Future Trends; Proceedings of the 14$^{th}$ International Thermal Spray Conference; May 22–26, 1995; 1197–1202; Kobe, Japan.

Crane et al.; Relationships Between Process Variables, Structure And Mechanical Properties of Arc Sprayed Steel Coatings; Surface Engineering Conference; 1985; 103–118.

Newbery et al.; The Electric Arc Spray Manufacture of Rapid Production Tooling: A Case Study; Proceedings of the 15$^{th}$ International Thermal Spray Conference; May 25–29, 1998; 1223–1228; Nice, France.

Zurecki et al.; Electric Arc Deposition of Carbon Steel Coatings with Imporved Mechanical Properties; Journal of Thermal Spray Technology: Dec. 1997; vol. 6(4);417–421.

Harris et al.; Influence of Heat Transfer on the Structure and Properties of Arc Sprayed Low Alloy Steels; Surface Engineering conference; 1985; 78–94.

Fussel et al.; A Sprayed Steel Tool for Permanent Mold Casting of Aluminum; SAE Technical Paper Series; Apr. 22–26, 1991; 1–7, Dayton, OH.

Volenik et al.; Properties of Alloy Steel Coatings Oxidized Dut=ring Plasma Spraying; Materials Science and Engineering; 1997; A234–236; 493–496.

Weiss et al.; Arc–Sprayed Steel–Faced Tooling; Journal of Thermal Spray Technology; Sep. 1994; vol. 3(3);275–281.

Smith et al.; An Investigatio of the Effects of DropletImpact Angle in Thermal Spray Deposition; Proceedings of the 7$^{th}$ National Thermal Spray Conference,; Jun. 20–24, 1994; 603–608; Boston, MA.

Kowalsky et al.; Diagnostic Behavior of the Wire–Arc–Plasma Spray Process; Proceedings of the International Thermal Spray Conference & Exposition; May 28–Jun. 5, 1992; 337–342; Orlando, FL.

Murakami et al.; Effect of Temperature Rise of Sprayed Deposits of an Fe–2.19wt.%C–0.68wt%Si Alloy During Thermal Spraying on the Structures and the Mechanical Properties; Materials Science and Engineering; 1994; A174; 85–94.

Prinz; Shaping by Deposition; Carnrgie Mellon University.

Steffens; Metallurgical Changes In The Arc Spraying Of Steel; British Welding Journal; Oct. 1966; 597–605.

Bredendick–Kamper et al.; AES Investigation Of Thermally Sprayed $Al_2O_3$ Coatings On Steel; Fresenius Journal Anal Chem; 1991; 341; 346–348.

Crane et al.; Relationships Between Process Variables, Structure and Mechanical Properties Of Arc Sprayed Steel Coatings; First International Conference On Surface Engineering; Jun. 25–28, 1985; 103–118; Brighton, UK.

Kim et al.; Heat Flow In Multi–Pass Arc Spraying Process; Surface And Coatings Technology; 1989;398–408.

Cronjager et al.; Investigationd About The Machinability Of Arc–Sprayed Steel Coatings; Proceedings Of The Eleventh International Thermal Spraying Conference; Sep. 8–12, 1986863–872; Montreal, Canada.

Steffans et al.; The Sonarc Process: Combining The Advantages Of Arc And HVOF Spraying; Journal Of Thermal Spray Technology; Dec. 1994; 398–403; vol. 3(4).

Weiss et al.; Rapid Prototyping Of Tools; Carnegie Mellon University; Oct. 1989; 1–23.

Bhargava et al.; Automated Ejectability Analysis And Parting Surface Generation For Mold Tool Design; Carnegie Mellon University; May 1991; 1–29.

Fussell et al.; Controlled Microstructure Of Arc Sprayed Metal Shells; Carnegie Mellon University; May 1991; 1–26.

Clyens; Rapid Tooling Manufactured By Spray Tool Steel Directly Onto Stereolithography Models.

He et al; Net Shape Simulation And Control; Proceedings Of The 7$^{th}$ National Thremal Spray Conference; Jun. 20–24, 1994; 415–419; Boston, MA.

Gill et al.; Monitoring Of Residual Stress Generation During Thermal Spraying By Curvature Measurements; Proceedings Of the 7$^{th}$ National Thermal Spray Conference: Jun. 20–24, 1994; 581–592; Boston, MA.

Rastegar et al.; On The Optimal Motion Planning For Solid Freeform Fabrication By Thermal SprayingProceedings Of The 7$^{th}$ National Thermal Spray Conference; Jun. 20–24, 1994; 463–483; Boston, MA.

Harris et al.; Influence Of Wire Composition And Other Process Variables On The Internal Stress Of Arc Sprayed Steel Coatings; DVS; 80; 245–249.

Greving et al.; Effects Of Coating Thickness And Residual Stresses On Bond Strength Of C633–79 Thermal Spray Coating Test Specimens; Proceedings of the 7$^{th}$ National Thermal Spray Conference; Jun. 20–24, 1994; 639–644; Boston, MA.

Knight et al.; Residual Stresses In Thermally Sprayed Coatings; Proceedings of the 1993 National Thermal Spray Conference; Jun. 7–11, 1993; 607612; Anaheim, CA.

Neiser et al.; Use Of A Computer Model To Assist In VPS Parameter Development; Proceedings of the 1993 National Thermal Spray Conference; Jun. 7–11, 1993; 61–66; Anaheim, CA.

Einerson et al.; Intelligent Control Strategies For The Plasma Spray Process; Proceedings of the 1993 National Thermal Spray Conference; Jun. 7–11, 1993; 205–211; Anaheim, CA.

* cited by examiner

IP Calibration Data vs. Theory

METHOD AND APPARATUS FOR CONTROLLING A SPRAY FORM PROCESS BASED ON SENSED SURFACE TEMPERATURES

CROSS REFERENCE TO RELATED APPLICATIONS

This application is related to and claims the benefit of U.S. Provisional Application No. 60/284,167, filed Apr. 17, 2001, and entitled, "AN AUTOMATED SPRAYFORM CELL," the disclosure of which is hereby incorporated by reference herein in its entirety.

BACKGROUND OF INVENTION

1. Technical Field

The present invention relates generally to spray forming methods and arrangements, and more specifically to automation of monitoring and control aspects of a spray form process.

2. Background Art

It is a known process to spray-form certain articles using moltenizing arc guns with metal wire supplied thereto. In order to moltenize the wire and form sprayable metal droplets, a significant amount of energy, typically manifest as heat, is applied at the arc gun to the wire. As a result, the temperature of the droplets is significantly elevated, and this elevated temperature is at least partially carried onward to the article being spray formed. Once the droplets land on the article and become a constituent component thereof, a portion of the heat energy travels conductively into the article, while the balance of the heat energy dissipates to the surrounding atmosphere. As a result, the temperature of the article, when considered in two and three dimensions, is often quite variable in a conventional metal spray-forming process. These variations or temperature gradients that are experienced across the body of the article during the spray-forming process can produce significant undesirable effects in the finished product.

One of the more significant detrimental effects that may occur is typically manifest as internal stress that is trapped within the substantially rigid article after its manufacture. Even though minor latent stresses may not significantly affect a finished article, it is not uncommon for stresses of magnitudes high enough to warp or otherwise cause deformation and deflection in the finished article to occur in uncontrolled spray processes. In such processes, it is not uncommon to experience temperature variations across the body of the article on the order of as much as 100° Celsius. Still further, even minor deflections due to internalized stress can render conventional spray form processes unuseable when precision tooling is required for particular finished products or articles.

In another aspect, as the technology and processes for spray forming metallic articles advance, the manufacture of larger and larger monolithic bodies is becoming feasible. As a result, however, the temperature gradients experienced in such larger spray formed bodies is becoming more pronounced due to their greater x-, y-, and also z-dimensions. Additionally, an increased magnitude in the experienced temperature gradients will result due to the greater time required to complete these larger bodies. The thicknesses (z-dimension) of the sprayed articles will also increase in order to support the shape of the more massive bodies. Each of these characteristics contribute to the experienced temperature variations as proportionally more heat is allowed to dissipate from the body at locations distant from where the arc guns are applying heated molten metal droplets at any given point in time during the spraying process. The result can be undesirable migrating "hot spots" or trails across the finished product.

The detrimental effects of these experienced temperature gradients across a spray formed article have long been appreciated; not the least of which can be, and often is, the inducement of internal stresses. Still further, currently available technology provides the user with an ability to control the amount of heat energy input into the wire in the moltenizing process. But, in spite of the recognized need, a continuing failure in the art has been an inability to accurately monitor and measure the experienced temperature(s) across the article's surface during the spray forming process on a real-time basis. Consequently, there has been a continuing inability to affect proper control over at least the heat energy input to the metal on a similar real-time basis for obviating the problems associated with temperature gradients induced in the article being spray formed.

In view of the above described deficiencies associated with unmonitored and uncontrolled spray form processes when considering temperature variations/gradients across the article being formed, the present invention has been developed to alleviate these drawbacks and provide further benefits to the user. These enhancements and benefits are described in greater detail hereinbelow with respect to illustrative embodiments of the present invention.

SUMMARY OF INVENTION

A new spray form cell for accommodating rapid tooling processes has been developed, primarily with the automotive industry in mind, in which a tool may be made by spray-forming molten steel onto a ceramic substrate. The molten steel is sprayed onto the ceramic substrate model that has been configured to produce a specifically shaped tool. In the instance of the manufacture of a stamping tool, the shape of the model corresponds to the article to be stamp-manufactured using the produced tool. In one embodiment, the spray is produced using a number of twin-wire arc plasma torches or guns. In an exemplarily embodiment, four such guns are utilized and their movement and performance is automated; that is, the guns are computer/robot controlled. Although most conventional thermal spray processes produce thin coatings on the order of 0.0098 inches (250 microns), this spray process is used to form much thicker deposits, for example, up to 0.24626 feet (75 mm).

During the spraying process, it is important that thermal gradients in the material be held to a minimum. That is to say, a uniform temperature is desired across the article being sprayed. In the exemplary embodiment, the article is a stamping tool suitable for use in high-production stamp-type manufacturing, such as that which is often employed in automotive manufacturing processes. Because of the relatively small size of the guns' spray plume, compared to the size of the article or billet being spray formed, careful control of the spray pattern is required. To obtain and assure even thermal distribution across the article during the spray deposition process, real-time monitoring of the article's temperature(s) is required.

According to the present invention, a two-wavelength imaging pyrometer is utilized to provide real-time measurement of the surface temperature distribution of a spray formed article. The imaging pyrometer provides a continuous stream of high resolution (on the order of 32,000-pixel) thermal images of the steel billet throughout the spray-forming process. The preferred imaging pyrometer, with its high sensitivity, measures temperatures as low as 392° Fahrenheit (200° Celsius). Through the use of two-wavelength sensing, the pyrometer is capable of making accurate surface temperature distribution measurements despite the scattering of light due to the dusty environment in the spray-forming process. Similarly, the selected pyrometer is also capable of making accurate temperature distribution measurements in spite of other opacity issues such as when the optical windows of the device become coated with dust and the degree at which light passes therethrough significantly degrades.

From an operational standpoint, the incorporation of such a real-time temperature measuring device enables control strategies that minimize or eliminate the stress-inducing characteristics of previously known processes. For instance, with an accurate, real-time, two-dimensional, temperature map of the exposed surface of the article being formed, spray gun operation and movement patterns can be altered to, among other things, minimize temperature variations across the article. From a monitoring or feed back perspective, the real-time temperature monitoring enabled by the pyrometer makes it possible to evaluate changes affected at the gun, regarding their effect on the article being sprayed.

The beneficial effects described above apply generally to the exemplary devices, mechanisms and method steps disclosed herein with regard to real-time monitoring and control of metal spray form techniques. The specific structures and steps through which these benefits are delivered will be described in greater detail hereinbelow.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
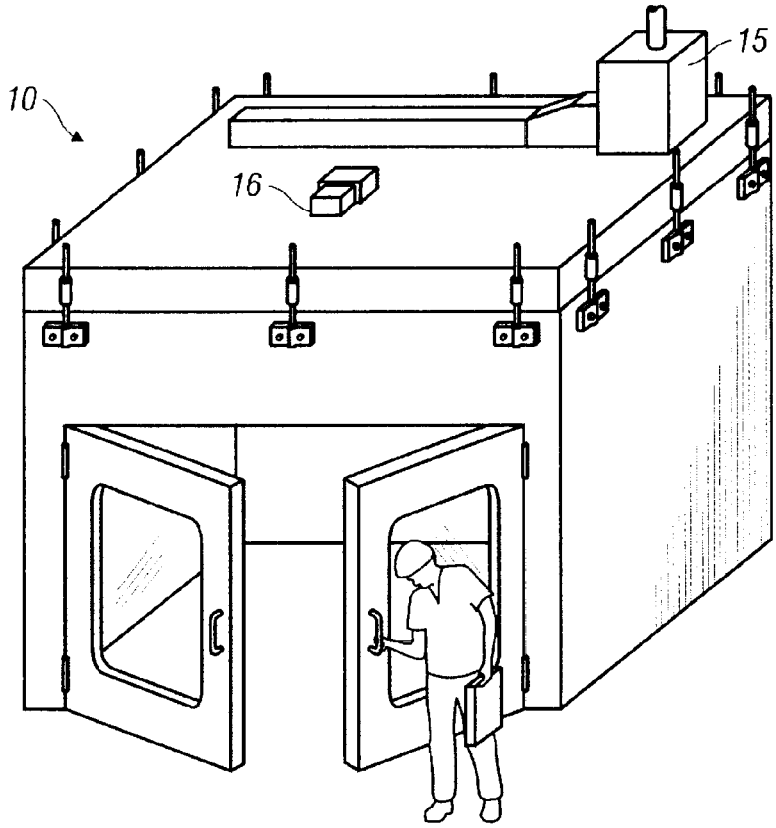
FIG. 1 is a perspective view of the exterior of a spray form cell illustrative of one embodiment of the present invention.
Figure 2:
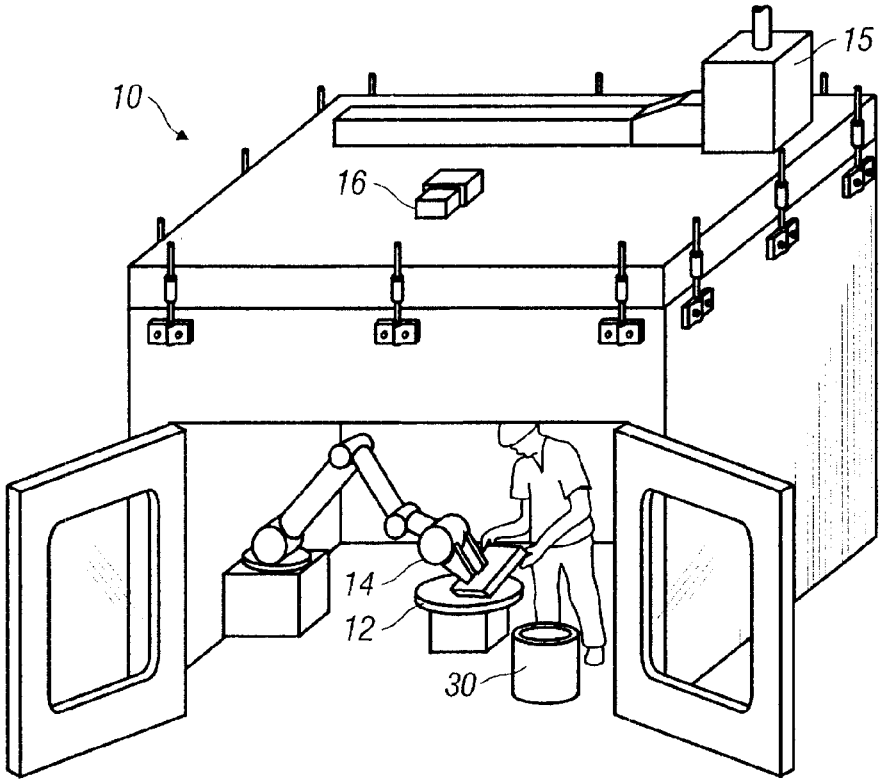
FIG. 2 is a perspective view of the interior of a spray form cell, including illustration of a model-carrying platform and spray guns or torches.
Figure 3:
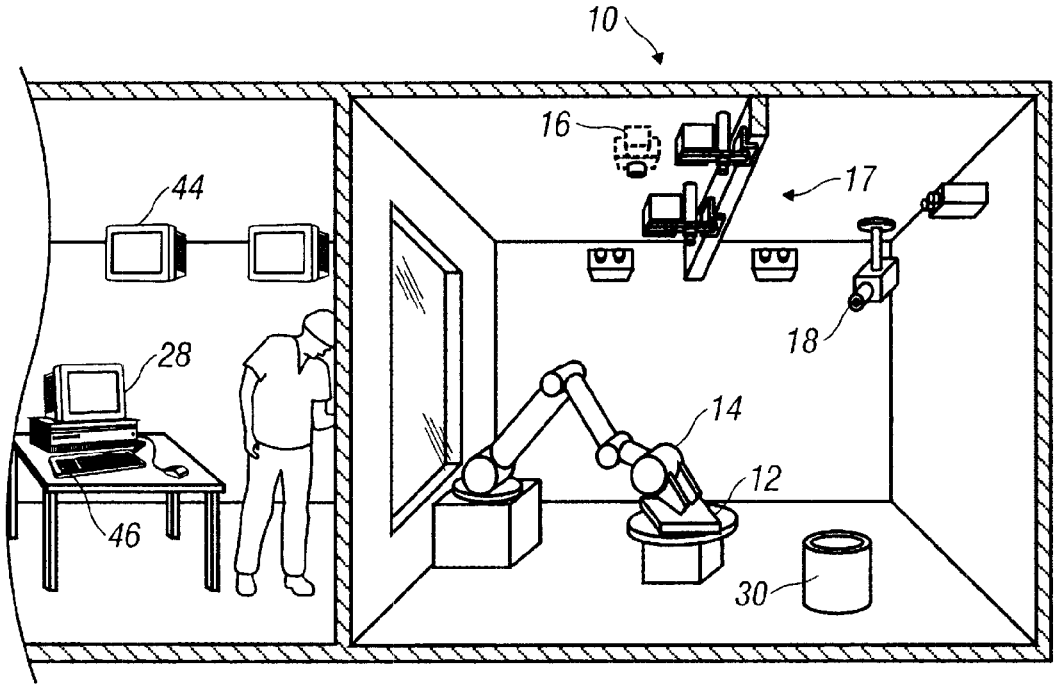
FIG. 3 is a partial sectional, perspective view of the interior of the a spray form cell, together with an adjacent monitoring and control room having an observation window positioned therebetween.

As will be described herein and which is illustrated in the accompanying drawings, exemplary trials utilizing the arrangement(s) and method(s) of the present invention have been undertaken. In these trials, an imaging pyrometer was installed in a rapid tooling spray forming facility, a structure that is also commonly referred to as a spray-form cell. An exemplary cell is illustrated in FIGS. 1–3. An exterior of the cell 10 is predominantly shown in FIG. 1. An interior configuration of the cell 10, including a model-carrying platform or table 12 and spray guns or torches 14, is shown in FIGS. 2 and 3. FIGS. 1 and 2 illustrate an abbreviated air exhaust arrangement 15 arranged to provide air exchange within the cell 10, as well as evacuate air-suspended particulate and other vision inhibiting material. Beyond the abbreviated duct work 15 that is illustrated, exhaust air is directed to a filtering system for removal of the suspended solids. FIG. 3 shows certain components of the cell 10 that are advantageously located near the ceiling of the cell 10 and which are used for process monitoring and control purposes. Among these components are an imaging pyrometer 16 configured according to the present invention, and a video camera 18.

In order to test the inventive concepts of the present invention(s), it was necessary to conduct certain trial or test runs in the rapid tooling cell 10. In these trials, it was found that the surface temperature of the sprayed material, as will be described in greater detail hereinbelow, can have temperature gradients in excess of 212° Fahrenheit (100 ° Celsius) when measured across the article being formed. As indicated hereinabove, the impact of these temperature gradients become particularly critical during the deposition process of larger articles or tools.

Several small test objects, as well as larger forms have been successfully sprayed according to the teachings of the present invention. One of the larger objects was in the form of a section of an inner hood stamping die that has been successfully sprayed and utilized in a stamping process. Heretofore, such large articles have not been able to be spray formed because suitable monitoring and control arrangements and methods have not been available.

Figure 4:
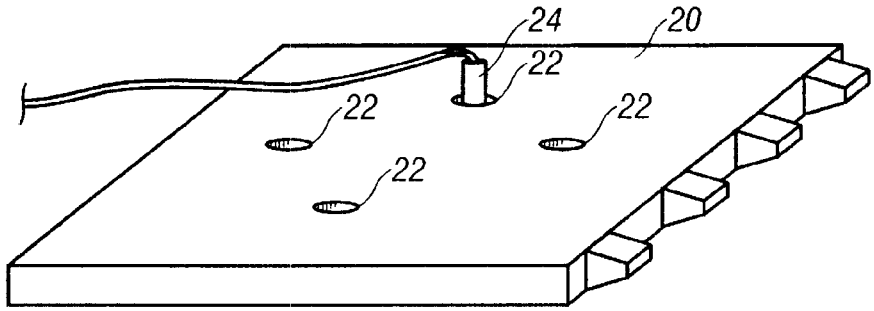
FIG. 4 is a perspective view illustrating one example of a controllable heat plate or thermal source useable to calibrate a pyrometer configured according to the present invention.

In order to test the efficacy of the present invention(s), a ceramic substrate was utilized that was embedded with thermocouples and then sprayed to compare the optical measurement of the surface temperature measured using the pyrometer 16 with a direct contact measurement from the thermocouples. This test arrangement is depicted in FIG. 4. The two measurements were in agreement until the deposition layer of the article became very thick and the measurements diverged. At that point, the thermocouples were measuring the ceramic and steel interface temperature, while the optical pyrometer 16 was measuring the temperature at the exposed steel surface that was building up and away from the interface.

The exemplary trial described herein provided validation of the thermal imaging measurements conducted according to the teachings of the present invention. Several thermal images of the various test objects that were sprayed are presented, showing the large thermal gradients that can exist in a billet when previous spray techniques are utilized. In general, the thermal maps show where the spray characteristics and pattern(s) must be modified to give a more uniform temperature distribution across the spray body. Therefore, in one embodiment of the present invention, the thermal imaging system is used to provide process control information at least for the heat energy or power applied to the wire arc torches 14, and also for the automated rastering (movement) control software.

The imaging pyrometer 16 utilized in the execution of the present invention has been developed especially for the thermal spray environment based on the unique requirements of the process. The pyrometer 16 is designed to measure high surface temperature distributions using a two-wavelength pyrometry technique. The design incorporates an optical head that produces two images of the source or target which are synthesized into a single focal plane array. The optical layout and software provide precise alignment and magnification of both wavelength images. Any two corresponding pixels in the simultaneously obtained two-wavelength images can be thought of as a two-wavelength radiometer which together are utilized to obtain accurate surface temperature readings.

The pyrometer 16 was developed to operate in longer wavelength ranges because of the relatively low-temperatures to be monitored in the spray forming process. The pyrometer 16 has a high quantum efficiency from 0.0000374 inches to 0.0000689 inches (0.95 to 1.75 microns). The long and short wavelength images are formed at 0.0000650 inches to 0.0000551 inches (1.65 and 1.40 microns), respectively, to optimize the response at low temperature. The resolution is 320×240 pixels. Since each intensity image covers half of the pyrometer 16, that is 160×240 pixels, the resolution of the thermal image is the same half frame format. The optics are similarly designed to operate at longer wavelength. The camera 16 has a frame rate of 30 Hz, and the image intensities are digitized with a 12 bit dynamic range. A large dynamic range is particularly important when a broad range of temperatures is to be sensed. This is especially true at low temperatures, where small changes in temperature cause large changes in intensity.

The two-wavelength imaging pyrometer 16 has a major advantage over single-wavelength pyrometers when there is opacity between the source or target and the pyrometer. The opacity can be from light (wave) scattering caused by dust particles, gaseous absorption, and/or other forms of obscuration in the optical path. This is an important characteristic when the spray form environment within the cell 10 is considered. Not only is a high degree of smoke generated from the moltenization of the feed wire at the torches 14, but a significant amount of air borne particulate is also produced from the spray process. Each of these characteristics combine to cause an opacity of the air of the cell 10, in spite of the efforts to remove the same using the provided exhaust system.

The two-wavelength imaging pyrometer 16 is a particularly advantageous configuration because of its insensitivity to opacity. This characteristic is predominantly attributable to the fact that the sensed temperature is determined from a ratio of the long to short wavelength intensity. If the opacity reduces both the long and short wavelength intensities by the same proportion, then the ratio temperature is unchanged. Conversely, the effect of opacity on a single wavelength pyrometer is significant in that the reduced intensity is mistaken for reduced temperature. For example, a single-wavelength device may measure a drop in temperature of 50 degrees responsive to a burst of opacity that reduces the intensity of the transmitted wavelength by a factor of ten.

The advantage of the two-wavelength imaging pyrometer 16 is especially important in such an industrial application in which the process may continue for many hours and the pyrometer 16 must operate across varying levels of dust and other obscuring gases that are produced in the metal spray forming process.

Two-wavelength imaging pyrometers have additional advantages over single-wavelength imaging pyrometers, or conventional thermal imaging cameras, when the surface emissivity is unknown or variable. Since thermal imaging cameras are typically calibrated using a black body having an emissivity near one, their output must be corrected when the emissivity is less than one. If the uncertainty in the emissivity estimate is large, this factor can be one of the largest contributors to error in the processed temperature. Again, the two-wavelength pyrometer 16 offers a unique solution. If the emissivity drops proportionally in the long and short pass-bands, then the ratio temperature is sensed correctly.

An object having an emissivity value of one at all wavelengths is known as a black-body. If the emissivity is less than one, but equal at all wavelengths, then the object is said to emit gray-body radiation. Two-wavelength pyrometers measure the correct temperature for all objects that are gray-body radiators. Fortunately, the gray body assumption is valid for a wide range of molten steel surfaces such as those produced in metallic spray forming processes.

The two-wavelength imaging pyrometers offer another advantage when the emissivity varies over the surface of the object. The errors due to variable emissivity are minimized, since each pair of pixels is used to form a long to short wavelength intensity ratio, and thereby, directly measures a ratio temperature. If the emissivity dropped from high to low within the field of view, the single-wavelength thermal imaging camera would require a variable correction factor that tracks the emissivity variation in the object.

The imaging pyrometer 16 utilized in the present invention has been designed to operate at comparatively low temperatures on the order of below 392° Fahrenheit (200° Celsius). This preferred parameter was chosen because historical measurements show a nominal temperature in the spray form processes to be about 572–752° Fahrenheit (300–400° Celsius). Since the sprayed steel surface emits gray-body radiation, the emitted radiation will have a Planck dependence on wavelength. In this low temperature range, the intensity has a peak at about 0.000197 inches (5 microns) and drops in both directions away from the peak. The intensity drops significantly on the short wavelength side of the peak in the Planck function. Since the sensitive band of the pyrometer 16, which is about 0.0000354 to 0.0000669 inches (0.9 to 1.7 microns), is located on the short wavelength side of the intensity maximum, the long and short wavelength filters are positioned at the long wavelength end of this response range. The short and long wavelength filters are centered at 0.0000551 to 0.0000650 inches (1.4 and 1.65 microns), respectively. Their pass-band width is about 0.00000787 inches (200 nm). For low temperature measurements, this selection provides for a maximum signal from the pyrometer 16.

As intimated above, a thermal source has been developed to calibrate the specially configured pyrometer 16. FIG. 4 illustrates an example of such a thermal source that may be used for calibration of the specially configured pyrometer 16 according to the teachings of the present invention. The source is constructed from a 3.94 inch by 3.94 inch (100 mm by 100 mm) piece of one-half inch thick steel plate 20. Four cartridge heaters are mounted in holes 22 drilled from one side of the plate 20 to establish a 3.94 inch by 3.94 inch (100 mm by 100 mm) thermal source. The surface of the steel plate 20 is painted with high emissivity black paint and thermocouples are mounted within the plate and on the viewed or target surface. The temperature of the source is controlled with a thermocouple-based temperature controller. An image is then recorded.

Referring to the exemplary embodiment of FIG. 4, the thermal source is positioned at a distance of 27.56 inches (70 cm) away from the pyrometer 16. One thermocouple 24 is shown to be attached to the surface of the thermal source and is visible in FIG. 4. Based on comparative readings from several utilized thermocouples located about the plate 20, a temperature drop from the interior of the plate 20 to the exposed surface was found to be a few degrees. Therefore, the measured front or exposed surface temperature, that is, the one viewed by the pyrometer 16, is utilized in the calibration procedures of the invention.

Figure 5:
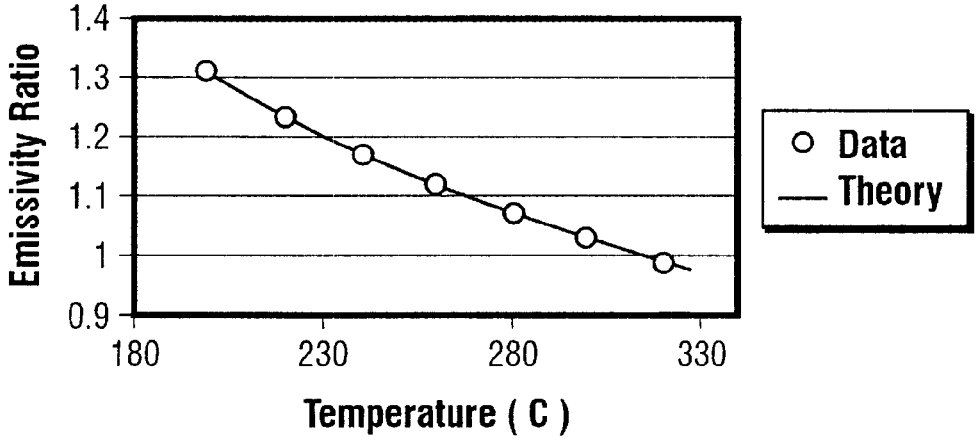
FIG. 5 depicts a graph illustrating an exemplary comparison of measured temperatures to theoretical estimates of a pyrometer's response, considering emissivity, according to one embodiment of the present invention.

In an exemplary calibration procedure, the temperature of the thermal source was varied in increments of 68° Fahrenheit (20° Celsius) and the radiance of a region near the surface mounted thermocouple was measured using the two-wavelength imaging pyrometer 16. The long wavelength intensity was divided by the short wavelength intensity at each temperature reading. The measured ratio was compared to a theoretical estimate of the instrument response, a relationship that is graphically shown in FIG. 5. The theoretical, or predicted values includes specific considerations for the pyrometer's optics and focal plane spectral response function. As may be appreciated from FIG. 5, good agreement was detected between the theoretical model and the measured value thereby confirming the invention's strategic utilization of the two-wavelength pyrometer 16 in a spray form cell environment.

Figure 6:
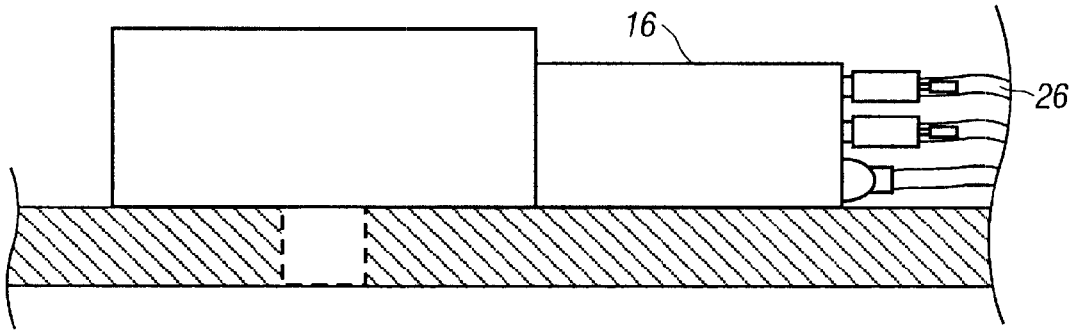
FIG. 6 is a partially sectioned, elevational view illustrating an example of the two-wavelength imaging pyrometer recessed installation at roof-level in the spray-forming cell.

In a trial of the method and arrangement of the present invention, the two-wavelength imaging pyrometer 16 described hereinabove was installed at roof-level in a spray forming cell 10 as illustrated in FIG. 6. A backside of the pyrometer assembly 16 is positioned outside the enclosure of the cell 10 and the focal or lens portion of the imaging pyrometer 16 has been advantageously configured to be inserted into an aperture through the ceiling. Still further, for protective purposes, the viewing lens of the pyrometer 16 has been advantageously recessed within the aperture away from the cell's 10 interior.

A digital interface cable 26 connects the pyrometer 16 to an acquisition computer 28 that is located in an adjacent monitoring and control room used to observe and govern operation within the cell 10; an exemplary arrangement is shown in FIG. 3. From this overhead position, the pyrometer-based imaging system's field of vision (FOV) covers the entirety of the spray-forming site.

In the exemplary arrangement, four wire arc torches or guns 14 were used to deposit molten steel onto a ceramic master model. The torches 14 operate in a programmed raster pattern (predefined movement or pattern) at a height of approximately 3.94 inches (100 mm) above the ceramic model's exposed surface that is configured to receive the moltenized sprayed metal for forming a tool thereupon.

Figure 7:
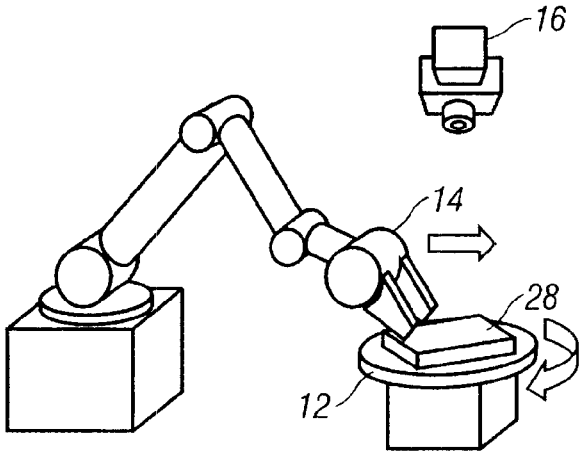
FIG. 7 is a schematic perspective view of certain components of the spray-forming equipment and an illustrative image of a ceramic master model positioned on the support platform or table with controllable movements of the gun and table indicated with arrows.

The model 28 may also be mounted to a mechanized platform or table 12 that is configured to vary the orientation and position of the model 28, together with that portion of the sprayed body that has been formed thereupon. For simplicity in construction, a preferred embodiment for this manipulation is controlled rotation during the spray forming process, a characteristic that is depicted by the rotation-indicating arrow in FIG. 7. This arrangement is provided, for among other reasons, to enable the minimization of thermal gradients across the surface of the article being formed as the moltenized metal is deposited onto the ceramic. A schematic of the spray-forming equipment and an exemplary ceramic master model 28 are shown in FIG. 7. In FIG. 7, the master model 28 is a large, 19.69 inch ×19.69 inch (500 mm×500 mm) ceramic hood section 28 that is positioned at the center of the rotation table or platform 12. Carefully controlled robot trajectories for the support arm and gun, as well as rotation rates for the substrate table 12, are utilized to minimize thermal gradients in the article being formed by the molten metal deposition process. Based on the real-time readings that are made by the imaging pyrometer 16 throughout the spraying process, feedback monitoring and feed forward control information is developed and provided to, among others, the automated trajectory and torch control computer and software of the arrangement.

The thermal spray head 14, which exemplarily contains four wire-arc plasma torches, produces a large quantity of plasma light during operation. The light produced at the arc gun(s) 14 is of sufficient intensity to saturate the imaging pyrometer 16 when molten metal is being sprayed thereby obscuring and preventing accurate thermal readings. Frequent starting and stopping of the spray process is not generally feasible. As a result, an arrangement and mitigating utilization process has been developed that enables accurate readings to be made using the pyrometer 16. A receptacle in the form of a bucket-styled enclosure 30 is provided in the cell 10 as exemplarily depicted in FIGS. 2 and 3. As shown therein, the enclosure 30 is designed to accept insertion of the thermal spray head of the guns 14 thereby forming a special light trap thereabout. In a preferred embodiment, the bucket-shaped enclosure that forms the light trap includes apertured walls. The apertures are provided in the walls so that when the moltenizing arc gun is being operated within the enclosure, back-pressure and spray-back of the moltenized metal is minimized. The feature of through-holes in the walls assists in preventing fouling of the guns when operated in the relatively tight interior space of the enclosure.

Figure 8:
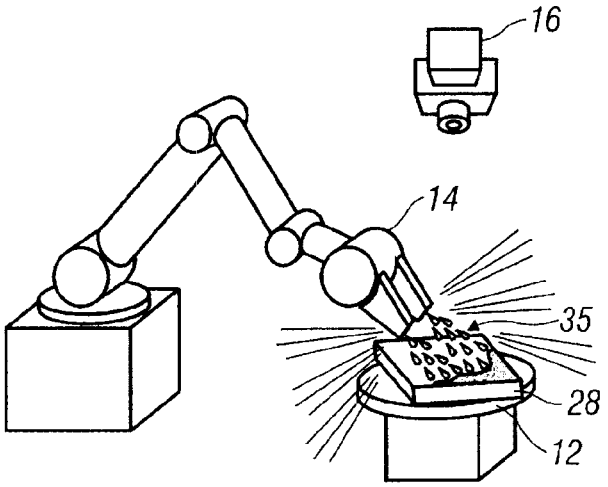
FIG. 8 is a schematic perspective view of an example of a thermal spray head, which may exemplarily contain four wire-arc plasma torches, applying moltenized metal to a ceramic model and the accompanying high intensity light that is produced as a by-product thereof.
Figure 9:
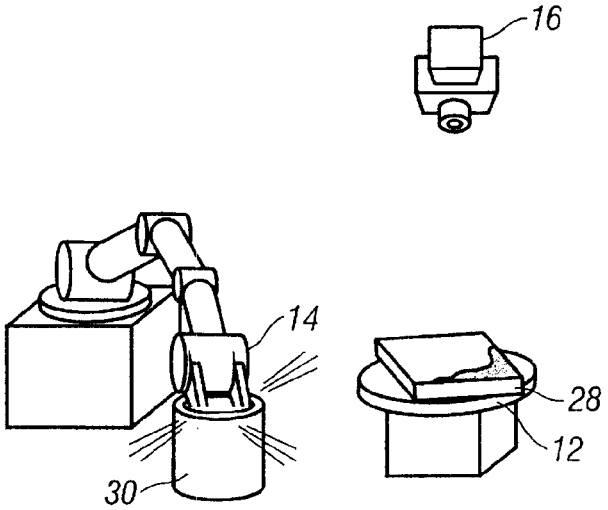
FIG. 9 is a schematic perspective view of the arrangement of FIG. 8, but with the thermal spray head positioned in a light shielding enclosure.
Figure 10:
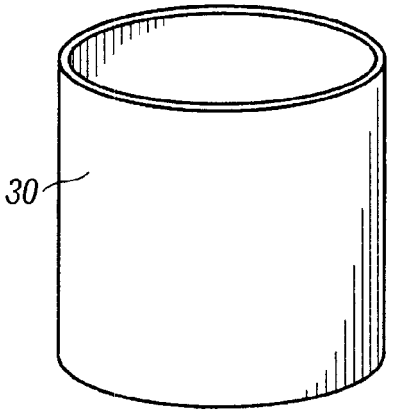
FIG. 10 is a perspective view an example of a light shielding receptacle in the form of a cylindrical or bucket-styled enclosure that may be provided in the spray-form cell for temporarily concealing the high intensity light produced by the operating plasma torches thereby enhancing accuracy of the pyrometer's readings.

The method for utilizing the light trap is shown by comparison of FIG. 8 in which molten metal 32 is being directed toward the master model, to FIG. 9 where the thermal spray head 14 is positioned in the trap 30. Incorporation of the light shield 30 has proven to be an effective method and arrangement for blocking plasma light away from the pyrometer 16 thereby enabling accurate surface temperature measurements to be made while the head 14 is shielded.

Still further, the enclosure 30 establishes a receptacle in which the spent moltenized metal is collected during the shielding process. If desired, this reservoired metal may be reclaimed and recycled thereby providing yet an additional benefit to the presently disclosed inventive method and arrangement.

Figure 11:
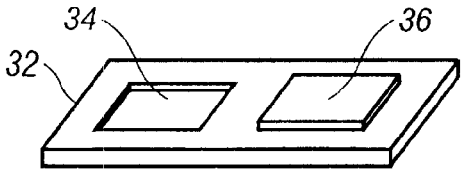
FIG. 11 is a schematic perspective view representing a test ceramic substrate or model utilized in verification procedures associated with the present invention.

The following describes a particular case study in which thermal measurements were initially taken of a rectangular ceramic substrate. A schematic representation of the test ceramic substrate 32 is shown in FIG. 11 upon which a steel billet was deposited. The ceramic substrate 32 contained a square cavity or depression 34 and a raised square platform 36. The thermal spray head 14 was pre-programmed to raster or move back and forth in a substantially uniform pattern. The rectangular ceramic substrate 32 had a length of 19.69 inches (500 mm) and the nominal size of the square forms 34, 36 was 4.72 inches (120 mm). The purpose of making measurements on such a simple object was to detect, and to correct system flaws that may have been caused in the installation process. This may also be considered a type of calibration of the arrangement.

In an initial spray run, it was confirmed that the plasma light source from the arc guns or torches 14 was too bright and that the light trap 30 can be advantageously utilized. The robot control software managed on the control computer 28 was initially setup to spray steel onto the ceramic substrate 32 in a controlled pattern until the desired steel billet thickness was attained. Due to the large size of the thermal spray head 14 which blocked a substantial portion of the billet from the pyrometer 16, and the high plasma light level, the automated control software was configured to move the head 14 periodically to the side of the table 12, and park it in the shielding receptacle 30 for a period of five seconds with the torches continuing to fire. During this periodic parked periods, a sequence of images of the steel billet were recorded and a temperature map constructed and displayed.

Figure 12:
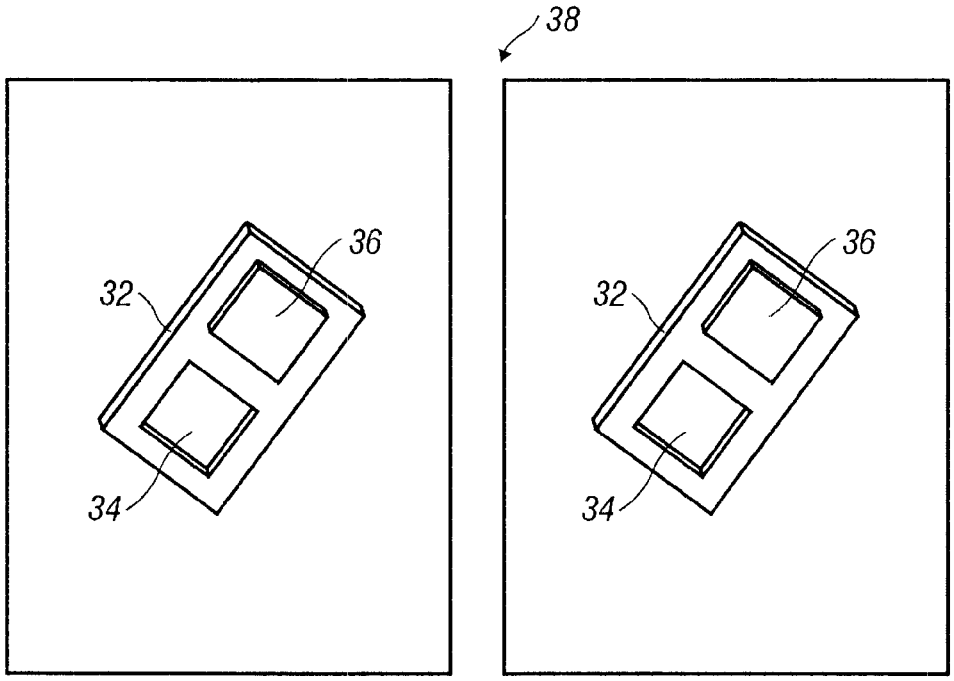
FIG. 12 is a schematic perspective view showing a pair of two-wavelength images (long to short wavelength intensity) of the rectangular ceramic substrate of FIG. 11.
Figure 14:
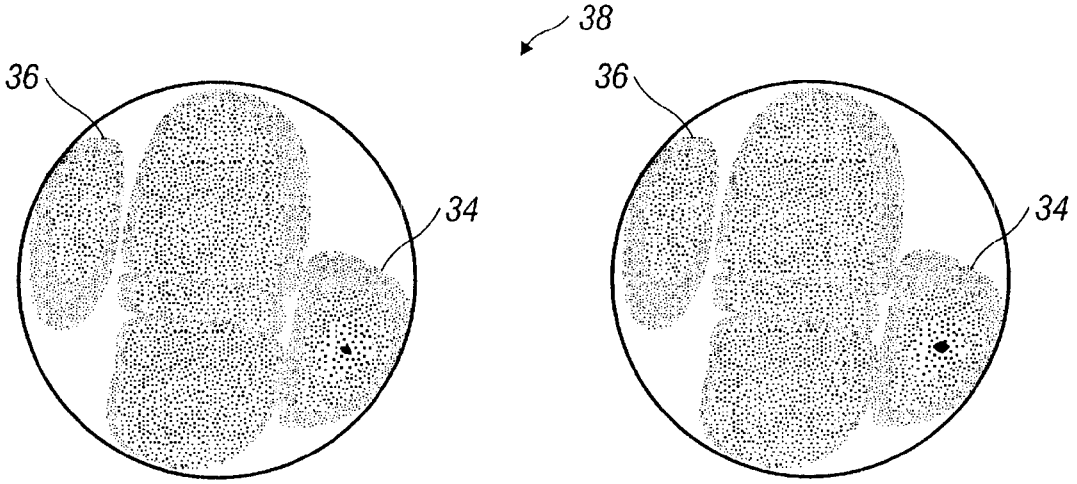
FIG. 14 represents screen displays exemplifying paired two-wavelength images of the steel billet being spray formed upon the model of FIG. 11 at a time about five seconds after the torch has been positioned in the light shield.

In FIG. 12, the combinable two-wavelength images 38 (long to short) of the rectangular ceramic substrate 32 are exemplarily illustrated and show the raised square 36 to be in the top of each of the images 38, while the cavity 34 is in the bottom. After the torch 14 was positioned in the light shield 30 to diminish the intensity of the light, thermal images of the rectangular steel billet were recorded. In FIG. 14, the two-wavelength images 38 (high and low) of the steel billet are shown at a time about five seconds after the torch 14 was positioned in the light shield 30. The shallow square cavity 34 is brighter than the raised square 36 which indicates that the cavity 34 has received and captured more of the molten steel droplets than the raised square 36 and thus has a higher temperature because of the greater quantity of recently moltenized spray metal. The temperature difference between these regions is illustrated in the combined or ratio temperature map 40 shown in FIG. 15 which is a representation of a color computer screen display. The temperature in the shallow cavity 34 is approximately 608° Fahrenheit (320° Celsius) while the temperature of the raised square 36 is approximately ten degrees cooler.

The adjacent brightness images indicate over-spray deposits 37 on each side of the cavity and depression.

Figure 15:
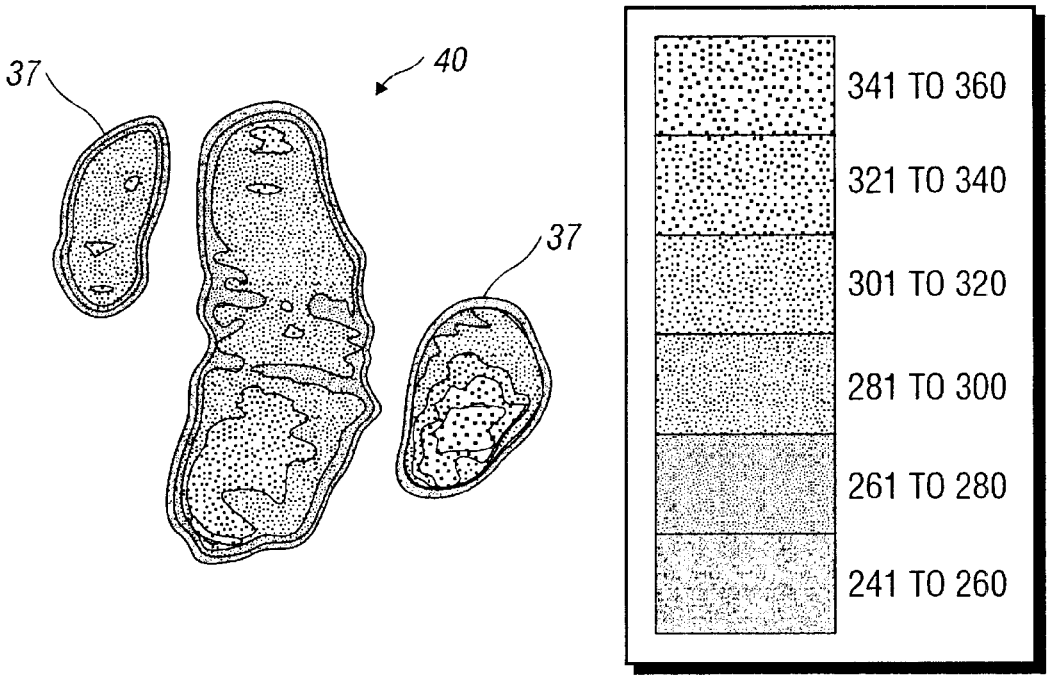
FIG. 15 represents a computer synthesized screen display exemplifying a combination of the paired two-wavelength images of the steel billet of FIG. 14 depicting temperature variations across the sprayed billet, together with a temperature legend located adjacent thereto.

It should be explained that the temperature map 40 of FIG. 15 does not show the rectangular shape of the deposit, because the intensity in the short wavelength image dropped below a threshold in certain area(s). Since the trajectory of the thermal spray head 14 resulted in such low intensity area(s), a compensating adjustment would be made in future exercises. The reduced intensity is a result of spraying insufficient material to maintain a uniform temperature. Proper adjustment would be possible to compensate for this deficiency on subsequent passes.

It has been learned that for large spray formed articles, the spray pattern and manipulation of the mounting table 12 are important characteristics to be able to control during the spray process. Billets up to and exceeding 7.87 square feet (2.4 square meters) may be desirably accommodated by arrangements and methods configured and practiced according to the present invention. For articles this large, however, automated, and optimally, integrated control of the gun(s) 14, together with manipulation of the platform 12 carrying the master model 28 is preferred. It becomes of the utmost importance in these applications to carefully control the thermal spray parameters and the application pattern, with respect to location and speed of molten metal application.

Figure 16:
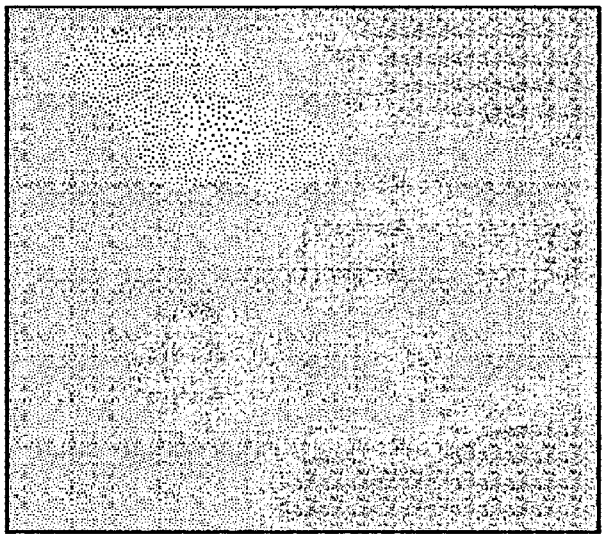
FIG. 16 represents a screen display of a radiance image of a relatively large inner-hood steel billet showing a substantial range of intensity levels or gradients thereacross.
Figure 17:
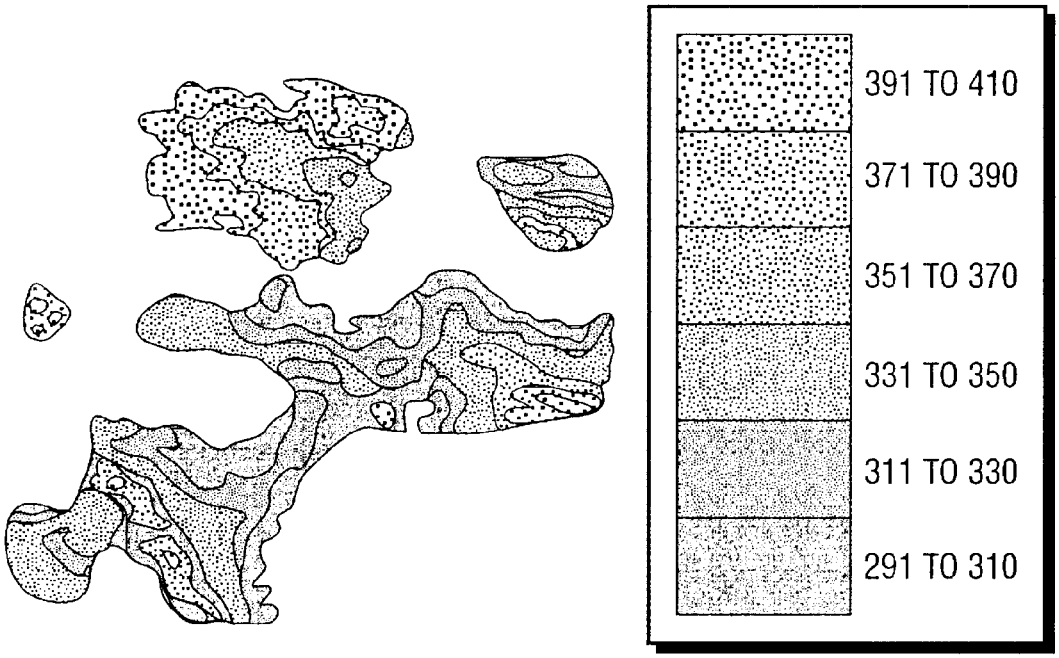
FIG. 17 represents a screen display of a radiance image based on the representation of FIG. 16 that has been filtered or computer-cropped about a threshold temperature range in the process of constructing an operator readable temperature image, together with a temperature legend located adjacent thereto.

In one example, thermal measurements were taken during the spraying of a large automotive hood component. The ceramic substrate 28 of the master model for an inner-hood component was utilized to study the thermal pattern obtained when spray-forming such a large billet. The size of the ceramic substrate 28 was about 1.64 feet square (0.5 meters square). The features of the model were in conformance with the actually component to be stamp-manufactured in the future using the steel billet created in this spray-forming process. The ceramic hood section model 28 was centered on a rotation table 12 as shown in FIG. 7. The ceramic substrate 28 was about 2.95 inches (75 mm) thick and the plasma torch 14 sprayed from a height of about 3.94 inches (100 mm) above the ceramic surface. Because of the large size of the section to be sprayed, it took several minutes for the deposit to heat to a temperature visible by the imaging pyrometer 16. After several minutes into the spraying process, however, it was clear that the raised surface features were heating up quicker than the rest of the billet. Compensating adjustments were effected. That is, less metal at lower heat was deposited in these "hot spots" until the detected temperatures evened out. The displayed radiance image of the inner-hood steel billet had a large range of intensity levels as depicted in the representation of FIG. 16. Clearly, more heat-indicating-light was being emitted from the raised features which were located closer to the passing guns 14. Much less light was being emitted from the valleys which were further away from the spray guns 14. The radiance image was cropped below a threshold in the process of constructing the displayed temperature image of FIG. 17 for clarity to an operator. Utilizing the monitoring and control functions of the invention, however, the billet was capably formed with significantly minimized temperature gradients during the spray process.

Figure 13:
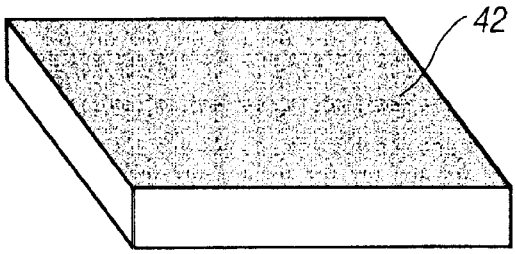
FIG. 13 illustrates a thermocouple adapted test form capable of conductively measuring surface temperatures thereof.

In an effort to test the pyrometer's accuracy, a ceramic plate was fitted with thermocouples to measure near-surface temperatures for comparison with pyrometer measurements. To accomplish the test, five holes or apertures were drilled through the plate and thermocouples were mounted even with the model's surface to be sprayed. An exemplary configuration of this arrangement is illustrated in FIG. 13. The plate was positioned on the rotation stage 12 and a protective steel plate was placed over the extending thermocouple wires.

Figure 18:
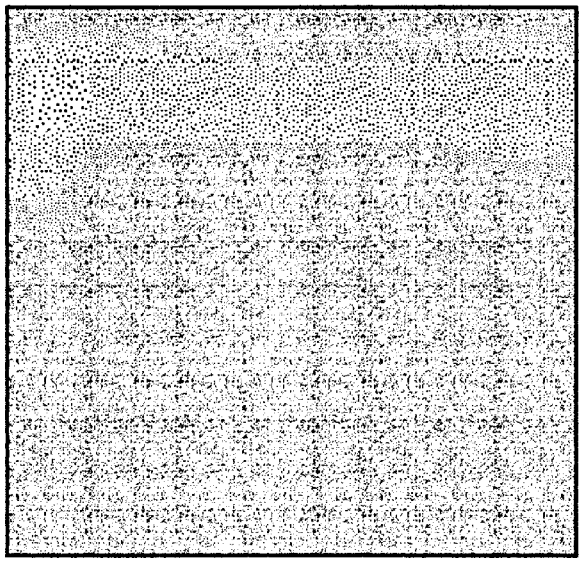
FIG. 18 represents a screen display of an initial pyrometer reading after turning the guns off.
Figure 19:
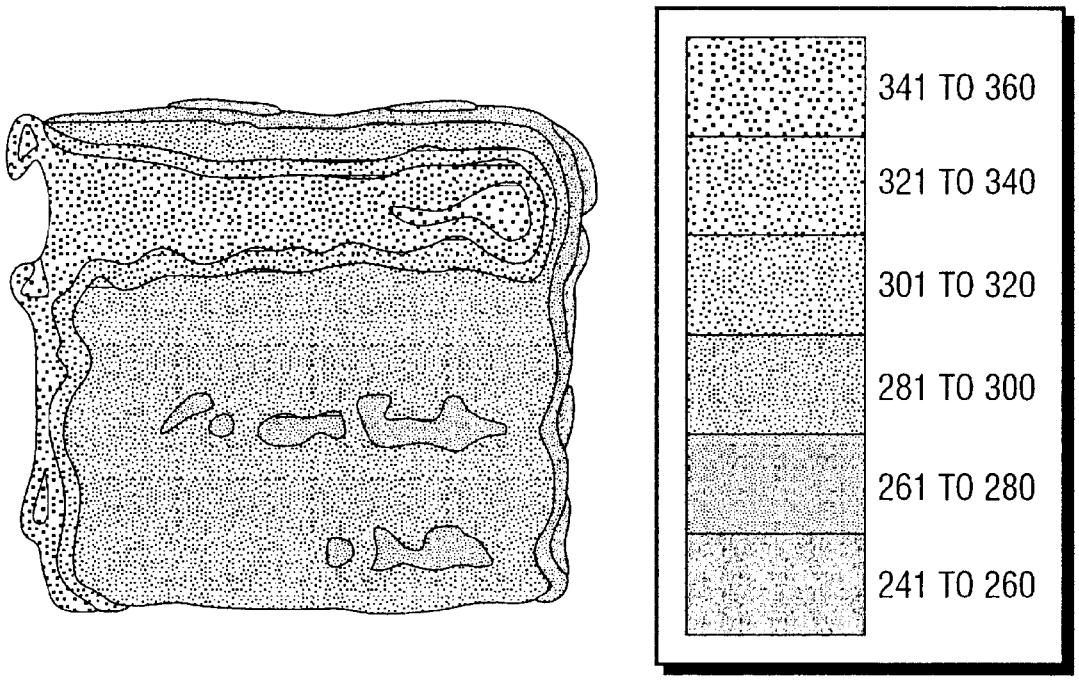
FIG. 19 represents a screen display of a corresponding pyrometer reading after two minutes have elapsed, together with a temperature legend located adjacent thereto.

A steel billet was then spray-formed over a period of about thirty minutes on the ceramic substrate 42. The ceramic substrate 42 was not rotated. The near-surface temperature was monitored at five points with the thermocouples. The surface temperature map, as measured with the imaging pyrometer 16, was also displayed throughout the forming process. The trajectory of the thermal spray head 14 during the deposition process biased its time spent over the upper edge of the model as compared to the rest of the deposit. As would be expected, this trajectory produced a high temperature band in the upper region as is evidenced in the pyrometer 16 generated representation of FIG. 18. The brightness image shown in FIG. 19 for the billet reveals that more light is emitted from this region indicating the presence of the higher heat content.

There was good agreement between the pyrometer's readings and the spaced thermocouple measurements for about fifteen minutes into the spraying process. As the spraying process continued, however, and the spray-formed body or billet became thicker on the ceramic substrate 42, the thermocouple measurements began to lag behind the pyrometer's 16 measurement of the surface temperature. By the end of the thirty minute spray process, the billet thickness had grown to about 0.236 inches (6 mm). As the billet grew in thickness, the billet/ceramic interface temperature began to drop away from the temperature of the surface exposed directly to the continuing spray-forming process.

Figure 20:
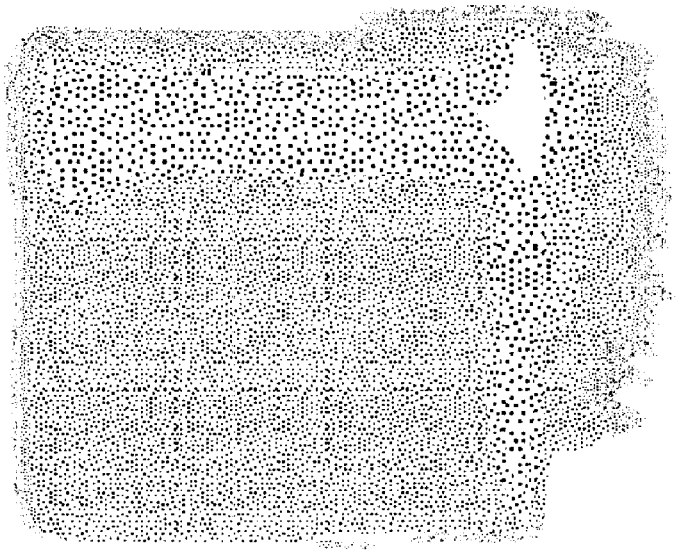
FIG. 20 represents another a screen display of a pyrometer reading of the cooling billet.
Figure 21:
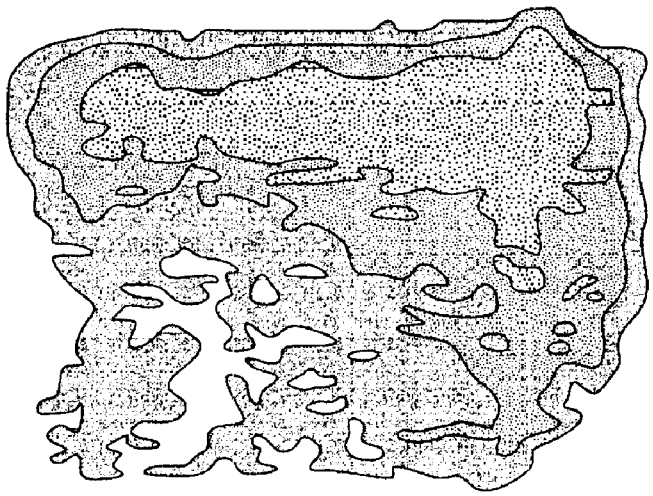
FIG. 21 represents still another a screen display of a pyrometer reading of the cooling billet.

The surface temperature of the billet was then tracked as a function of time after the spray torches 14 had been turned off. The pyrometer 16 recorded images at a rate of 1 Hz. FIG. 20 represents the computer screen color display of the pyrometer's 16 initial reading after the guns 14 were turned off. The representation of FIG. 21 shows a corresponding reading after two minutes had elapsed. Not surprisingly, the billet cooled slowly, as would be expected of a large thermal mass.

A primary and important aspect of the present invention is the integration of the two-wavelength imaging pyrometer 16 into the thermal spray process for monitoring and control purposes. As explained hereinabove, monitoring the temperature of the billet or article being sprayed using the pyrometer 16 is but one part of its beneficial functionality. In this step, temperature data is developed in which temperature values are ascertained and assigned locations with respect to the article being sprayed. Depending on the size of the location points or areas, more or less accurate mapping is made possible regarding temperature variations across the billet. In the case of small pixel-type points, an essentially continuous mapping is accommodated and which has a high degree of definition. Typically, these temperature values are located using coordinates measured from a known reference point. In this way, a plurality of temperature values can be indexed to any particular location or region and differentiated one from another based on time read. Thus, the temperature of the locations can be monitored for current status information, and the same information can also be used for future control purposes. This configuration also enables the collection of historical temperature measurements that may be utilized for post-process analytical purposes, or predictive purposes in setting control parameter (s).

FIG. 3 illustrates the interior of a control room for a spray form process that is executed in the spray form cell 10 depicted in FIGS. 1–3. In the control room's upper monitor 44 as shown in FIG. 3, real-time images or video is displayed of the interior of the cell 10. The camera 18 that provides these images is viewable in the upper right corner of the spray cell 10 as shown in FIG. 3. For protective purposes, the camera 18 may be advantageously shrouded in a shield and it may be fixedly mounted, or operator remotely manipulatable. If manipulatable, the field of vision may be adjusted to view the billet being sprayed, or to view other areas of the cell 10 that are of interest to the operator during the spray forming process.

Another monitoring and feed-back aspect of the spray form process is also exemplarily illustrated in FIG. 3. Therein, an arrangement 17 for taking dimensional measurements of the article is represented. By repetitively measuring distances from one or more fixed points to the exposed surface of the article as it is being sprayed, the increasing thickness of the billet can be mapped and considered in the control strategy for the spray from process. More specifically, this information can be time-marked and correlated to the time based temperature information generated by the pyrometer and governing computer system.

The computer monitor shown in FIG. 3 directly below the video monitor 44 provides a visual display of the temperature mappings of an article or billet that is being spray formed. Preferably, this representation is in color for better operator appreciation. The source data for generating these representations is received from a sensor; preferably in the form of a two-wave length pyrometer as specified herein. The display may be real-time based and continuously updated and likely changing, or may be in "snap-shots" representative of particular points in time. Regardless of the nature of the temperature measurement, the present invention utilizes the monitored temperature information as a control parameter for future spraying.

As described above, the spraying process is preferably automated. That is, at least certain operating parameters of the spray guns 14 are automatically controlled, preferably based on computer programs that are algorithm-based. These parameters exemplarily include the amount of heat energy input into the sprayable metal during the moltenizing process at the arc gun 14, as well as the speed and operating path, or rastering of the guns 14. In this way, the temperature of the billet may be smoothed toward a uniform, and possibly continuous, temperature across the article by affecting these parameters. For instance, if a low temperature region is detected, one or more of the guns 14 may be directed to that area of the article and high-energy molten metal sprayed thereupon for increasing that region's temperature and thereby improving the uniformity in temperature across the article. In this manner, operation of the spray forming process can be automated to minimize temperature variations and avoid the institution of internal stresses within the article.

The computer's 28 monitor may also provide a visual representation of control parameters of the spray process. As shown, the inputs for these controls may be provided on an automated basis, for instance from the temperature mapping function of the two-wavelength imaging pyrometer 16. These automated control aspects are advantageously complemented by operator input and over-ride capabilities. As shown, the operator input device exemplarily takes the form of a computer keyboard 46, but may be provided in the form of any suitable input device(s) adapted to convey operator-based changes to the spray process' control.

Downstream from the processor 28 that formulates the control commands and accepts operator input, instructions are transmitted to the manipulating arrangements for the guns 14 and the platform 12 upon which the master model and article are carried. The instruction transmission may be made over any suitable conveyance, with two examples being hardwire connections and radio transmit-and-receive configurations.

Figure 22:
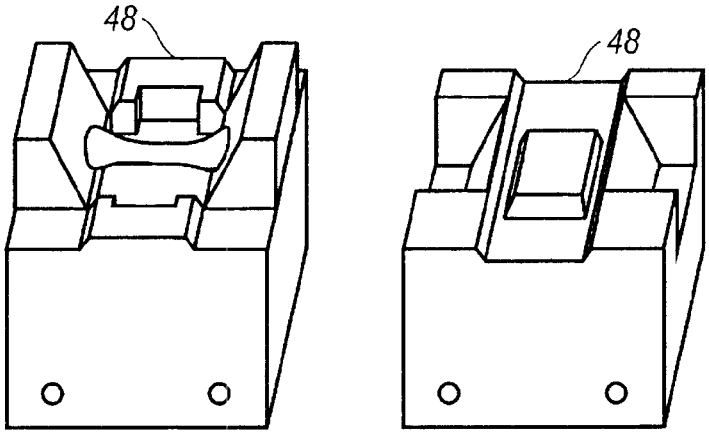
FIG. 22 is a perspective view of two examples of steel billets or tools having complex surface topology that have been created by spraying molten steel onto a ceramic substrate containing the required surface structure according to the present invention.
Figure 23:
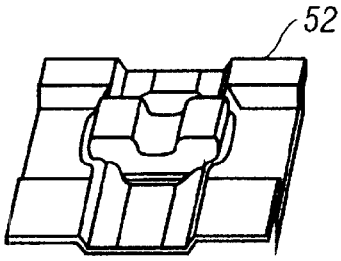
FIG. 23 is a perspective view of an example of a metal sheet product stamped utilizing a stamping tool such as those illustrated in FIG. 22.
Figure 24:
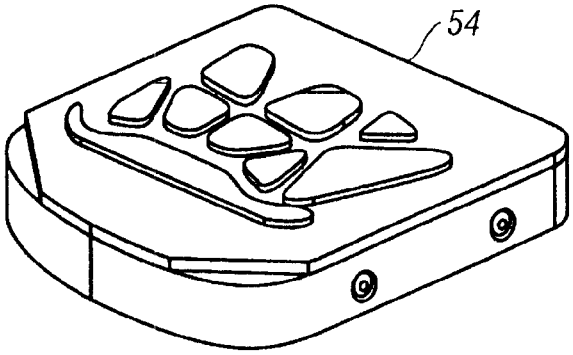
FIG. 24 is a perspective view of an example of a type of large stamping tool for an automobile inner hood that is capable of being created from a plurality of smaller tools pieced together, or that may be sprayed as a monolith according to at least one embodiment of the present invention.

In summary, the characterizations and anecdotal data contained herein demonstrate the utility and success of the presently disclosed invention's advantageous integration of a two-wavelength imaging pyrometer 16 into a thermal spray process. The spray-form process may be advantageously used to create steel billets 48 with complex surface topology by spraying molten steel onto a ceramic substrate representing the required surface structure. Two examples of such structures are exemplified in FIG. 22. Such steel billets may be utilized as tools, particularly stamping tools, in the automotive, as well as other industries requiring metal-faced tools. Advantageously, these tools may be rapidly created using the spray-form process. An exemplarily stamped metal sheet 52 is shown in FIG. 23. A large stamping tool 54 such as that shown in FIG. 24 for an automobile inner hood may be created from a plurality of smaller tools that are pieced together, or may be sprayed as a single-body monolith.

As explained hereinabove, the spray-forming of large steel tools is complicated because careful control must be exercised over the process to avoid inducing thermal stresses. To reduce stresses in the spray-formed tool, it is critical that temperature gradients be minimized across the tool throughout the process and that the correct spray temperature be as accurately maintained as possible. The utilization of the two-wavelength imaging pyrometer 16 enables efficient and accurate measurement of surface temperature distributions across the tool throughout the spray-forming process; a feat which has heretofore not been accomplished, in spite of the long-appreciated need to control stress through temperature control.

Various preferred embodiments of the invention have been described in fulfillment of the various objects of the invention. It should be recognized that these embodiments are merely illustrative of the principles of the invention. Numerous modifications and adaptations thereof will be readily apparent to those skilled in the art without departing from the spirit and scope of the present invention.

What is claimed is:

1. A method for controlling the manufacture of a spray formed article, comprising:

applying multiple layers of spray forming material upon a mold substrate in the manufacture of a spray formed article;

detecting temperatures of an exposed surface of the spray formed article during application of the spray forming material with an infrared sensor; and controlling application conditions of a subsequently applied layer of spray forming material based on the detected temperatures of the exposed surface of the article being formed.

2. The method of claim 1, further comprising detecting temperatures of the exposed surface of the spray formed article simultaneously at a plurality of locations.

3. The method of claim 2, further comprising establishing a two-dimensional temperature map for the exposed surface.

4. The method of claim 3, wherein establishing the two-dimensional temperature map further comprises ascertaining temperature values and assigning location points of the ascertained temperature values with respect to the exposed surface.

5. The method of claim 4, wherein assigning the location points of the ascertained temperature values further comprises assigning small pixel-type location points of the ascertained temperature values to establish a high definition temperature map.

6. The method of claim 4, wherein assigning the location points of the ascertained temperature values further comprises assigning the location points of the ascertained temperature values using coordinates measured from a predetermined reference point.

7. The method of claim 2, wherein detecting the temperatures of the exposed surface further comprises detecting the temperatures simultaneously at a plurality of locations at different times.

8. The method of claim 7, further comprising establishing a two-dimensional temperature map for the exposed surface by ascertaining temperature values and assigning location points of the ascertained temperature values with respect to the exposed surface and indexing the temperature values for each assigned location point differentiated from one another based on the time detected.

9. The method of claim 1, further comprising detecting temperatures substantially continuously across the exposed surface of the spray formed article.

10. The method of claim 9, further comprising establishing the two-dimensional temperature map for a substantial entirety of the exposed surface.

11. The method of claim 1, further comprising calibrating the infrared sensor by detecting a temperature at the mold substrate during initial application of the multiple layers of spray forming material and making adjustments to the sensor based thereupon.

12. The method of claim 1, wherein detecting the temperatures with the infrared sensor further comprises detecting the temperatures with a two-wavelength imaging pyrometer type infrared sensor.

13. The method of claim 1, further comprising calibrating the infrared sensor by conductively detecting a temperature at the mold substrate during an initial application of the spray forming material and adjusting the sensor to produce a similar reading.

14. The method of claim 1, further comprising detecting temperatures across the exposed surface of the spray formed article and thereby producing real-time thermal information, the thermal information being utilized in the control of application conditions of a subsequently applied layer of spray forming material.

15. The method of claim 14, further comprising controlling the application conditions of the subsequently applied layer of spray forming material by a computing device coupled to the infrared sensor.

16. The method of claim 15, wherein controlling the application conditions by the computing device further comprises providing a visual display by the computing device of a two-dimensional temperature map established according to the detected temperatures of the exposed surface of the article being formed.

17. The method of claim 15, wherein controlling the application conditions by the computing device further comprises taking dimensional measurements of the article being formed by repetitively measuring distances from one or more predetermined fixed points to the exposed surface of the article being formed.

18. The method of claim 17, wherein taking the dimensional measurements further comprises mapping an increase in the thickness of the spray forming material on the mold substrate during application of the spray forming material.

19. The method of claim 1, further comprising providing a light shield for the infrared sensor against plasma light emitted in connection with application of the spray forming material to enable accurate detection of surface temperatures with the infrared sensor.

20. The method of claim 19, wherein a spray head is employed to apply the layers of spray forming material upon the mold substrate, the step of detecting temperatures comprising placing the spray head in the light shield while detecting the temperatures of the exposed surface of the spray formed article.

21. The method of claim 19, wherein the light shield comprises a bucket shaped member.

22. The method of claim 19, wherein the bucket-shaped member has apertures.

23. The method of claim 1, wherein the spray formed article is separated from the mold substrate after the application of the spray forming material.

24. The method of claim 23, wherein the mold substrate is made of ceramic material.

25. The method of claim 23, wherein the spray formed article has a thickness of up to 75 millimeters.

26. The method of claim 23, wherein the article comprises at least a part of a shaping tool.

27. The method of claim 1, wherein the infrared sensor is capable of measuring temperatures of the article without knowing the emissivity of the article being sensed.

28. The method of claim 27, wherein the infrared sensor comprises a two-wavelength imaging pyrometer.

29. The method of claim 28, wherein the pyrometer has a viewing lense that is located within a recess in a ceiling above the mold substrate.

30. The method of claim 28, wherein the two-wavelength pyrometer has a sensitive band of about 0.9 to 1.7 microns.

31. The method of claim 28, wherein the pyrometer has a short wavelength filter centered at 1.4 microns and a long wavelength filter centered at 1.65 microns, and wherein the passband of each filter is about 200 nanometers.

32. The method of claim 28, wherein the spray forming material is a material that emits gray body radiation.

33. The method of claim 1, wherein each of the layers of spray forming material are made of the same material.

34. The method of claim 33, wherein the spray forming material is steel.

35. A method for controlling the manufacture of a spray formed article, comprising:

applying multiple layers of spray forming material upon a mold substrate in the manufacture of a spray formed article;

detecting temperatures of an exposed surface of the spray formed article during application of the spray forming material with an infrared sensor;

controlling application conditions of a subsequently applied layer of spray forming material based on the detected temperatures of the exposed surface of the article being formed with a computing device coupled to the infrared sensor; and detecting temperatures across the exposed surface of the spray formed article and thereby producing real-time thermal information, the thermal information being utilized in the control of application conditions of a subsequently applied layer of spray forming material;

wherein controlling the application conditions by the computing device further comprises allowing a user to input operator override commands to the computing device via an input device.

* * * * *